US008869722B2

(12) United States Patent
Kojima et al.

(10) Patent No.: US 8,869,722 B2
(45) Date of Patent: Oct. 28, 2014

(54) BEAD FEEDER

(75) Inventors: Terutada Kojima, Nagoya (JP); Taichi Fukushima, Kasugai (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 13/410,684

(22) Filed: Mar. 2, 2012

(65) Prior Publication Data

US 2012/0222597 A1 Sep. 6, 2012

(30) Foreign Application Priority Data

Mar. 3, 2011 (JP) ..... 2011-046318

(51) Int. Cl.

| | |
|---|---|
| ***D05B 3/00*** | (2006.01) |
| ***D05B 3/22*** | (2006.01) |
| ***D05B 3/12*** | (2006.01) |
| ***D05B 3/18*** | (2006.01) |
| ***D05C 7/02*** | (2006.01) |
| *D05C 7/08* | (2006.01) |

(52) U.S. Cl.

CPC .. *D05B 3/22* (2013.01); *D05C 7/02* (2013.01); *D05D 2303/12* (2013.01)

USPC ..... 112/113; 112/104; 112/106; 112/114; 112/99; 112/115

(58) Field of Classification Search

USPC ..... 112/99, 104, 106, 113, 404, 258, 259, 112/260; 223/48

See application file for complete search history.

(56) References Cited

U.S. PATENT DOCUMENTS

| | | | | | |
|---|---|---|---|---|---|
| 1,212,181 | A | * | 1/1917 | Brell | 221/173 |
| 1,497,697 | A | * | 6/1924 | Rice | 221/239 |
| 2,960,049 | A | * | 11/1960 | Guedry | 112/113 |
| 3,633,524 | A | * | 1/1972 | Hoffsommer et al. | 112/113 |
| 4,594,953 | A | * | 6/1986 | Ando et al. | 112/112 |
| 4,690,077 | A | * | 9/1987 | Nirenberg | 112/113 |

FOREIGN PATENT DOCUMENTS

| | | |
|---|---|---|
| CN | 201459405 U | 5/2010 |
| EP | 2 228 476 A1 | 9/2010 |

* cited by examiner

*Primary Examiner* — Danny Worrell
*Assistant Examiner* — Katharine Gracz
(74) *Attorney, Agent, or Firm* — Rossi, Kimms & McDowell LLP

(57) ABSTRACT

A single bead-shaped piece fed from a storage pipe storing therein a large number of bead-shaped pieces is carried not on a bearing plate but on a support member provided independently from the bearing plate. The support member is arranged movable on the bearing plate in conjunction with forward and backward movement of a feeding member, and also arranged to be moved relative to the feeding member at the time of the forward or backward movement thereof. The support member is provided with a clamping section for clamping the bead-shaped piece, which is adapted to clamp the bead-shaped piece in conjunction with the relative movement of the feeding member and the support member. This permits the bead-shaped piece to be delivered properly from the storage pipe to the sewing position in a stable manner, and hence a sewing machine can reliably sew the bead-shaped piece on a sewing material.

4 Claims, 8 Drawing Sheets

BEAD FEEDER

BACKGROUND

This structure provides the following positional adjustments. When the operator turns the adjusting screw 15 clockwise or counterclockwise with the support plate 14 released from the fixed position, the support plate 14 is linearly moved forward or backward relative to the second bracket 13 whereby the fore-aft positional relation between the second bracket 13 and the support plate 14 is adjusted. Further, lateral positional relation between the first bracket 12 and the support plate 14 is adjusted by making adjustment of the fixed position of the second bracket 13 relative to the first bracket 12. Namely, the support plate 14 is mounted to the mounting base 6 stepwise by way of the first bracket 12 and the second bracket 13, and hence the support plate 14 can be positioned at any fore-aft/lateral position based on the mounting base 6 moved up and down along the base 5 by making adjustment of the positional relations with the respective brackets 12, 13. It is noted that a bead feeding direction (to the right as viewed in FIG. 1 and FIG. 3 and to the rear as viewed in FIG. 2) is defined herein as "forward" direction.

The feed lever 23 is formed with a recess 23*a* at a distal end thereof opposite from a proximal end to which the coupling member 22 is fixed for coupling the swing arm 20 to the feed lever 23. The recess 23*a* is configured to receive a part of a single bead B as a feed material such that the bead B fed from the storage pipe 30 through the through hole 29*a* may be directly fed to the sewing position as held in a horizontal position relative to the top surface of the bearing plate 18. The feed lever 23 is configured to be varied in thickness in two steps such that the distal end formed with the recess 23*a* is thinner than an intermediate portion thereof. Thus, a bottom surface of the feed lever 23 that is opposed to the bearing plate 18 defines different heights from the bearing plate 18, the height changing at the intermediate portion thereof. Since the distal end of the feed lever 23 defines the greater height from the bearing plate 18 than the side with the coupling member 22 fixed thereto, the feed lever 23 can provide space beneath the distal end thereof such as to accommodate a support member 24 independent from the feed lever 23. The support member 24 is configured to have a thickness such that a bottom surface of the support member 24 is flush with the bottom surface of the thicker portion of the feed lever 23.

The support member 24 is forwardly formed with a depressed portion 24*a* which carries thereon a single bead B fed from the storage pipe 30. In order that the bead B is not carried directly on the bearing plate, the support member 24 (more specifically, the depressed portion 24*a*) capable of slidable movement along with the feed lever 23 on the bearing plate 18 is adapted to carry thereon the bead B. The support member 24 is further formed with a recess 24*b* at a distal end of the depressed portion 24*a* such as to permit the passage of the sewing needle 4. In a state where the bead B is carried on the bearing plate 18 (more specifically, the bead B is held by a pair of clamping claws 25 to be described hereinlater), a bead hole of the carried bead B is aligned with the recess 24*b*.

The pair of clamping claws 25 (a clamping section) is disposed on the depressed portion 24*a* in a manner to be interposed between the feed lever 23 and the depressed portion. For assuredly holding (retaining) the bead B with tips thereof, the paired clamping claws 25 are arranged in a manner to direct the respective claw portions thereof in face-to-face relation, the claw portions being formed in an arc-like shape conforming to an outer periphery of the bead B. These clamping claws 25 are each formed with an engaging hole 25*a*, and also formed with an engaging groove 25*b* defined by a corresponding outer peripheral portion thereof recessed toward the engaging hole 25*a*. A first pin (first member) 26 upstanding from the support member 24 is inserted in the engaging hole 25*a* of each of the clamping claws 25 so that each clamping claw 25 is supported by the support member 24 in a manner to be rotatable about the engaging hole 25*a*. Further, the engaging groove 25*b* of each of the clamping claws 25 is engaged with a second pin (second member) 27 upstanding from the distal end of the feed lever 23. According to the above structure, the support member 24 is not fixedly mounted to the feed lever 23 but is allowed to move back and forth slightly relative to the feed lever 23. For this purpose, the position of the step formed on the bottom of the feed lever 23 and the length of the support member 24 are so decided as to ensure that a clearance is formed between the step on the bottom of the feed lever 23 and a rear end surface of the support member 24 when the feed lever 23 is at the rearmost position.

As described above, the bead feeder conventionally known in the art includes the groove formed in the bearing plate for guiding the bead(s) and the forward and backward movement of the feed lever. One or more of the beads stacked in the storage pipe are once transferred into the groove in the bearing plate, and then are slidably moved on the bearing plate by the feed lever movable in the groove so as to be delivered one by one to the sewing position. Therefore, while delivered by using the feed lever, the bead is subjected to frictional resistance from the bearing plate (specifically, the groove). The frictional resistance fluctuates according to conditions of contact of the delivered bead with individual areas (such as, bottom surface, side surface and the like) of the groove. Hence, the frictional resistance may vary for each bead. If so, the load on the drive motor to operate the feed lever varies according to the magnitude of the frictional resistance on the bead being delivered. Therefore, the load on the drive motor fluctuates on a bead to bead basis.

In this connection, it has been a practice for the conventional bead feeder to require a large motor having such a large drive force as to provide an extra margin, so that the bead can be assuredly delivered to the sewing position even if the bead encounters rather heavy frictional resistance from the individual areas of the groove. In spite of the extra force margin, however, it is not always ensured that a frictional resistance heavier than expected can never be encountered. In the case of such an unexpectedly heavy frictional resistance, the drive motor loses steps, disadvantageously becoming unable to deliver the bead. In the conventional bead feeders, the mechanism for clamping the bead with the paired engaging claws utilizes the spring bias force. If the frictional resistance between the bead and any of the areas of the groove is unduly increased for some reason (for example, the bead is tilted to hit hard against the bottom surface of the groove in the course of delivery), the bead is disengaged from the paired engaging claws spring-biased to clamp the bead therebetween, and hence the bead cannot be delivered. That is, the conventional bead feeders are incapable of proper and stable bead delivery, failing to ensure that the bead is reliably sewn onto the sewing material.

SUMMARY OF THE INVENTION

In view of the foregoing, the present invention has an object to provide a bead feeder that is capable of proper and stable bead delivery from the storage pipe storing therein a large number of stacked beads to the predetermined sewing position in order to ensure that the bead is reliably sewn onto the sewing material.

According to the present invention, a bead feeder for delivering separate bead-shaped pieces one by one from a storage pipe to a position just beneath a sewing needle of a sewing machine in accordance with forward and backward movement of a feeding member reciprocally moved on a top surface of a bearing plate, the storage pipe storing therein a large number of separate bead-shaped pieces in stacked relation, the bead feeder comprises: a support member for carrying, on the bearing plate, a single bead-shaped piece fed from the storage pipe, the support member arranged movable on the bearing plate in conjunction with the forward and backward movement of the feeding member, the support member arranged to be moved relative to the feeding member at the time of the forward or backward movement of the feeding member; and clamping section for clamping the single bead-shaped piece carried on the support member, the clamping section operative to clamp the bead-shaped piece in conjunction with the relative movement of the feeding member and the support member.

According to the present invention, a single bead-shaped piece fed from the storage pipe storing the large number of stacked bead-shaped pieces is carried not on the bearing plate but on the support member disposed independently from the bearing plate, the support member adapted to move on the bearing plate in conjunction with the forward and backward movement of the feeding member. Furthermore, the support member is arranged movable relative to the feeding member at the time of the forward or backward movement of the feeding member. The support member is provided with the clamping section for clamping the bead-shaped piece, which is operative to clamp the bead-shaped piece in conjunction with the relative movement of the feeding member and the support member. Thus, the bead-shaped piece on the support member is delivered together with the support member from the storage pipe to the position just beneath the sewing needle of the sewing machine. Hence, the bead-shaped piece is free from the frictional resistance which the bearing plate known in the art may suffer when the bead-shaped piece is being delivered. The bead-shaped pieces are always smoothly delivered. Accordingly, the load on the drive motor for driving the feeding member does not vary for each bead-shaped piece so that the stable delivery of the bead-shaped pieces can be accomplished without increasing the size of the drive motor. Furthermore, the bead-shaped piece being clamped is delivered in conjunction with the movement of the feeding member so that the bead-shaped piece can be properly delivered in a more stable manner. This permits the sewing machine to reliably sew the bead-shaped pieces onto the sewing material.

According to the present invention, a single bead-shaped piece fed from the storage pipe is carried on the support member and delivered together with the support member while the operation of clamping the bead-shaped piece on the support member is performed in conjunction with the support member moved relative to the feeding member. Thus, the present invention offers an effect that the bead-shaped piece can be delivered from the storage pipe to the predetermined sewing position in a proper and stable manner.

BRIEF DESCRIPTION OF DRAWINGS

For better understanding of the object and other features of the present invention, its preferred embodiments will be described hereinbelow in greater detail with reference to the accompanying drawings, in which.

DETAILED DESCRIPTION

First Embodiment

Figure 1:
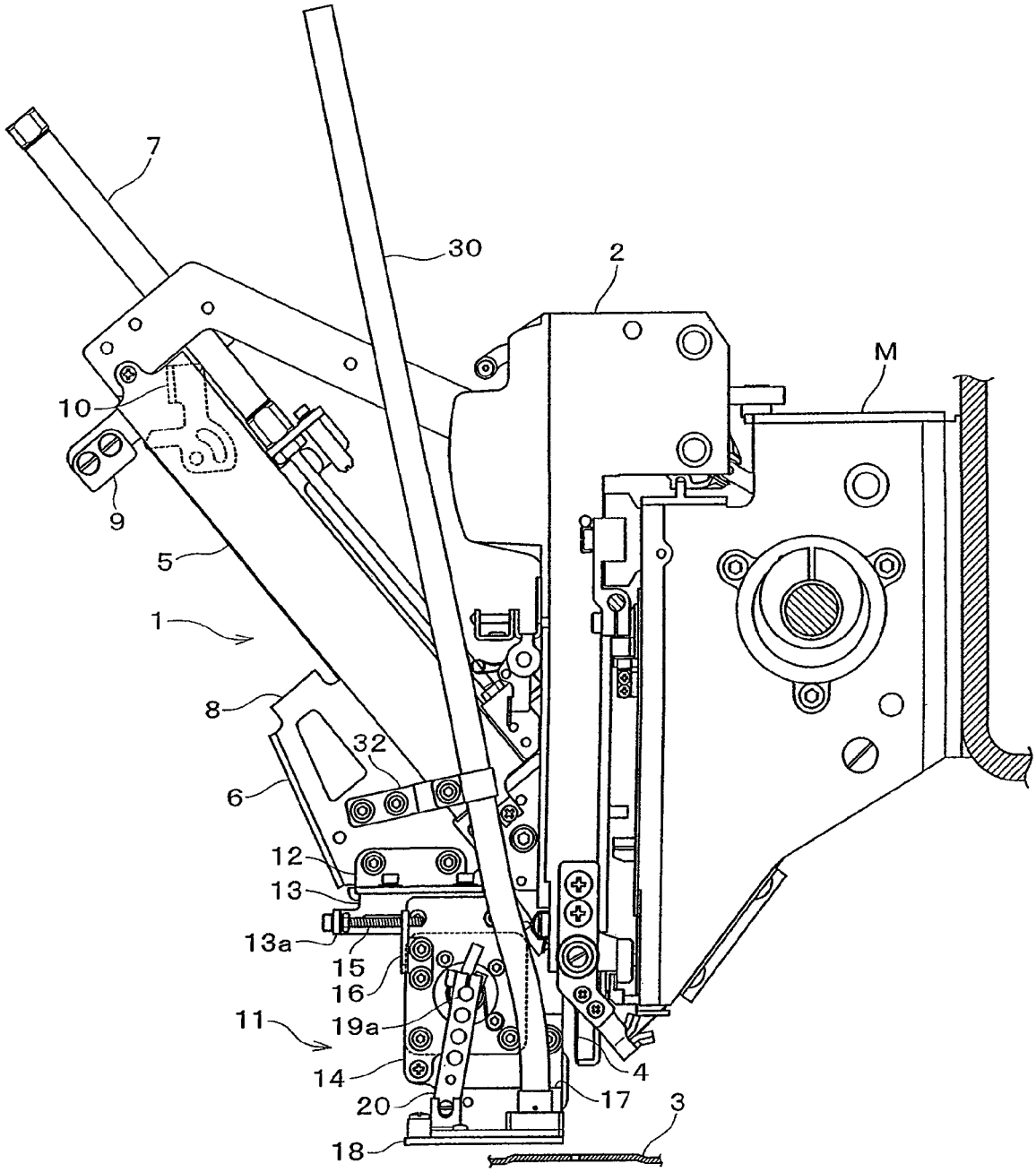
FIG. 1 is a right side view showing a sewing machine equipped with a bead feeding unit according to a first embodiment of the present invention.

FIG. 1 is a right side view of a sewing machine equipped with a bead feeding unit (bead feeder) 1 according to a first embodiment of the present invention as viewed from the front right-hand side thereof. The sewing machine includes a machine head M, a needle bar case 2 and a needle plate 3. The needle bar case 2 shown here has a multi needle configuration including a plurality of sewing needles 4. The bead feeding unit 1 is adapted to be mounted to a left side surface and/or a right side surface of the needle bar case 2. The embodiment illustrates a sewing machine having the bead feeding unit 1 mounted only to the left side surface of the needle bar case 2. In a case where the bead feeding unit 1 is mounted to the left side surface of the needle bar case 2 as suggested by the embodiment, the leftmost one of the plural sewing needles 4 in the needle bar case 2 is used as a bead needle.

Figure 2:
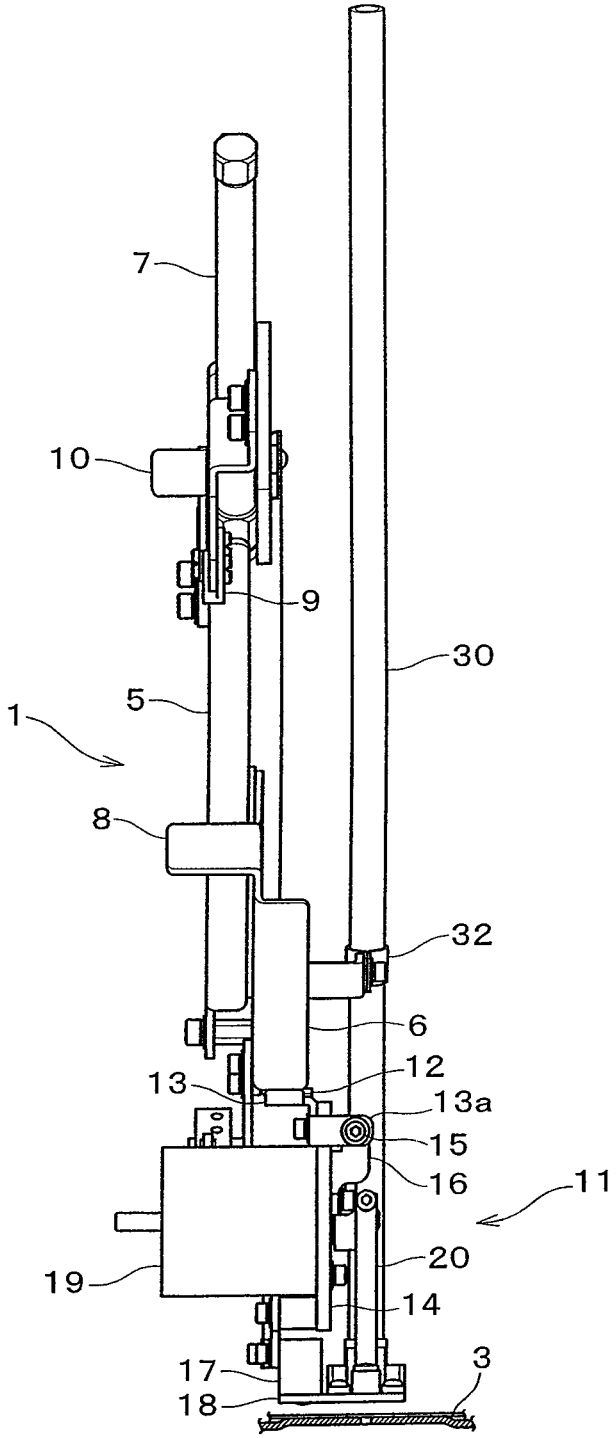
FIG. 2 is a front view showing the bead feeding unit.

FIG. 2 is a front view showing the bead feeding unit 1. As shown in FIG. 1 and FIG. 2, the bead feeding unit 1 includes a base 5 for mounting the unit 1 to the left side surface of the needle bar case 2, and a mounting base 6 vertically movably assembled to the base 5. An air cylinder 7 is mounted to an upper part of the base 5. The air cylinder 7 drivably moves the mounting base 6 up and down along the base 5 in a predetermined range. That is, the mounting base can be moved down to a predetermined downward position to sew beads onto a sewing material as shown in FIG. 1 and FIG. 2 and moved up therefrom to a predetermined retreat position (not shown) where the bead sewing is not performed.

An upper portion of the mounting base 6 defines a grip portion 8 which an operator holds for manually moving up or down the mounting base 6. A stopper 9 is fixed to an upper end of the base 5 such that the grip portion 8 may abut against the stopper 9 when the mounting base 6 is moved up along the base 5 to the retreat portion, thereby inhibiting any further upward movement of the mounting base 6. A lock member 10 is pivotally mounted to a side surface of the base 5 at place near the location of the stopper 9. After manually moving up the mounting base 6 to the retreat position by means of the grip portion 8, the operator can turn the lock member 10 into engagement with the grip portion 8 thereby preventing the mounting base 6 raised to the retreat position from going down under its own weight.

Figure 3:
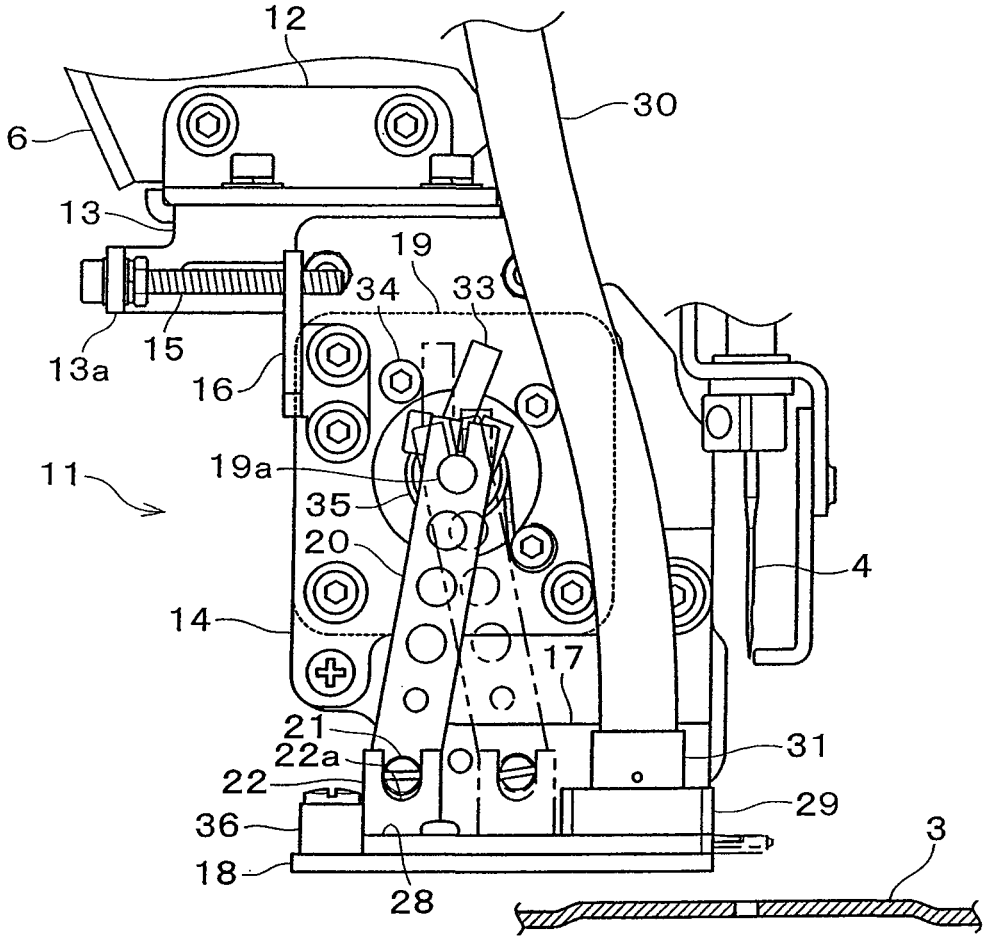
FIG. 3 is a side view showing a bead feeding mechanism of the bead feeding unit in enlarged dimension.

The mounting base 6 is provided with a bead feeding mechanism 11 at a lower end thereof, the bead feeding mechanism 11 serving to deliver the beads from a storage pipe 30 to a sewing position. FIG. 3 is a side view showing the bead feeding mechanism 11 of the bead feeding unit 1 in enlarged dimension. As seen from FIG. 3, a first bracket 12 having an L-shape is fixed to the lower end of the mounting base 6. A second bracket 13 is fixed to the first bracket 12 in a position adjustable manner such that the second bracket 13 can be positioned at any lateral position as seen in FIG. 2. A support plate 14 is fixed to the second bracket 13 in a position adjustable manner such that the support plate 14 can be positioned at any fore-aft position (lateral position in FIG. 3). An adjusting screw 15 is pivotally mounted to a support portion 13*a* facing the front as bent at a right angle to the second bracket 13 and is in an axially unmovable relation therewith. A threaded portion of this adjusting screw 15 is threadably engaged with a screw hole of a guide member 16 fixed to the support plate 14.

This structure provides the following positional adjustments. When the operator turns the adjusting screw 15 clockwise or counterclockwise with the support plate 14 released from the fixed position, the support plate 14 is linearly moved forward or backward relative to the second bracket 13 whereby the fore-aft positional relation between the second bracket 13 and the support plate 14 is adjusted. Further, lateral positional relation between the first bracket 12 and the support plate 14 is adjusted by making adjustment of the fixed position of the second bracket 13 relative to the first bracket 12. Namely, the support plate 14 is mounted to the mounting base 6 stepwise by way of the first bracket 12 and the second bracket 13, and hence the support plate 13 can be positioned at any fore-aft/lateral position based on the mounting base 6 moved up and down along the base 5 by making adjustment of the positional relations with the respective brackets 12, 13. It is noted that a bead feeding direction (to the right as viewed in FIG. 1 and FIG. 3 and to the rear as viewed in FIG. 2) is defined herein as "forward" direction.

A support block 17 is disposed under the support plate 14. A bearing plate 18 for bearing a feed lever (feeding member, see FIG. 4) 23 thereon is horizontally assembled to a lower end of the support block 17, the feed lever 23 serving to deliver a bead B from the storage pipe 30 to the sewing position. Further, a drive motor 19 is fixed to the support plate 14 while a swing arm 20 is fixed to a motor shaft 19*a*.

Figure 4:
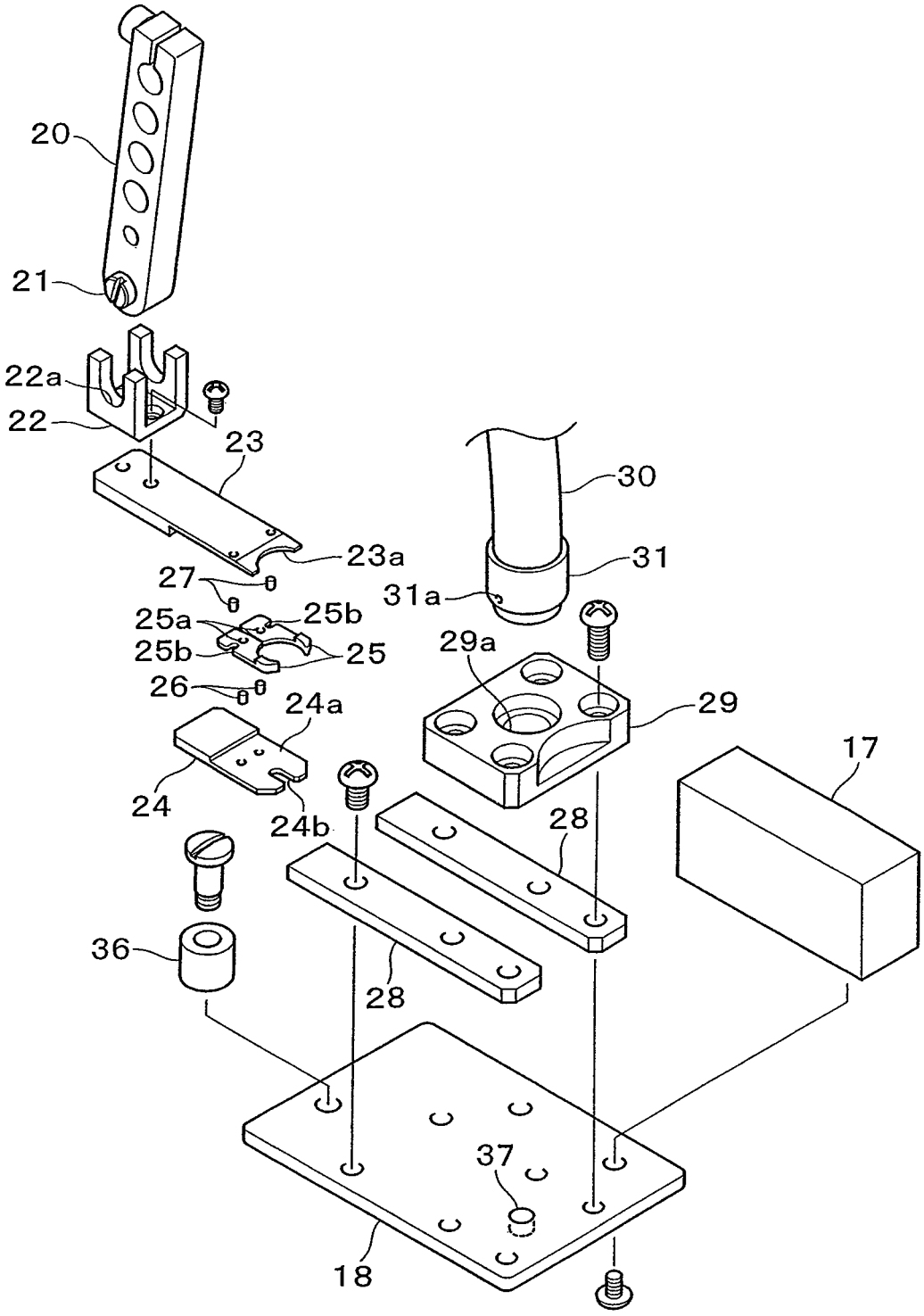
FIG. 4 is an exploded perspective view showing the bead feeding mechanism.

Next, the bead feeding mechanism 11 is described. FIG. 4 is an exploded perspective view showing the bead feeding mechanism 11. As shown in FIG. 4, the swing arm 20 has one end mounted to the motor shaft 19 of the drive motor 19 and the other end fixedly assembled with a coupling pin 21. Both ends of the coupling pin 21 project from side surfaces of the swing arm 20. The projected ends of the coupling pin 21 are fitted in engagement recesses 22*a*, respectively, which are formed in opposite side walls of a U-shaped coupling member 22. The coupling member 22 is fixed to an upper side of the feed lever 23 placed on the bearing plate 18. According to this structure, the feed lever 23 is drivenly moved forward and backward in conjunction with the swing arm 20 driven by the drive motor 19 to swingably reciprocate through a predetermined angular range.

A pair of guide plates 28 is fixed to a top surface of the bearing plate 18. The guide plates 28 are so located as to slidably hold the feed lever 23 therebetween on the lateral sides thereof, the feed lever being placed on the bearing plate 18. The forward and backward movement of the feed lever 23 (in horizontal direction) is controlled by these guide plates 28. Namely, the feed lever 23 is slidingly moved forward and backward on the bearing plate 18 (sliding movement) as guided by the pair of guide plates 28. Such a pair of guide plates 28 is designed to have a thickness slightly greater than that of the feed lever 23. A pipe base 29 is fixed to upper sides of forward ends of the paired guide plates 28 in a manner to bridge a gap therebetween. The pipe base 29 suppresses up-down (vertical) flapping motion of the feed lever 23 being moved forward or backward.

The pipe base 29 is formed with a through hole 29*a* allowing the passage of the bead B. The through hole 29*a* is adapted for fitting engagement with a coupling member 31 fixed to a lower end of the storage pipe 30 storing therein separate beads B in stacked relation. On the other hand, an intermediate portion of the storage pipe 30 is fixed to the mounting base 6 by means of a bracket 32. Thus, the storage pipe 30 is designed such that the open lower end thereof can be fixed to a predetermined position above the bearing plate 18 (specifically, the location of the through hole 29*a*). And through the lower end of the storage pipe 30, the beads B in the storage pipe 30 are fed out one by one. Hence, the storage pipe 30 is not moved from the fixed position even when the feed lever 23 is moved forward and backward.

The feed lever 23 is formed with a recess 23*a* at a distal end thereof opposite from a proximal end to which the coupling member 22 is fixed for coupling the swing arm 20 to the feed lever 33. The recess 23*a* is configured to receive a part of a single bead B as a feed material such that the bead B fed from the storage pipe 30 through the through hole 29*a* may be directly fed to the sewing position as held in a horizontal position relative to the top surface of the bearing plate 18. The feed lever 23 is configured to be varied in thickness in two steps such that the distal end formed with the recess 23*a* is thinner than an intermediate portion thereof. Thus, a bottom surface of the feed lever 23 that is opposed to the bearing plate 18 defines different heights from the bearing plate 18, the height changing at the intermediate portion thereof. Since the distal end of the feed lever 23 defines the greater height from the bearing plate 18 than the side with the coupling member 22 fixed thereto, the feed lever 23 can provide space beneath the distal end thereof such as to accommodate a support member 24 independent from the feed lever 23. The support member 24 is configured to have a thickness such that a bottom surface of the support member 24 is flush with the bottom surface of the thicker portion of the feed lever 23.

The support member 24 is forwardly formed with a depressed portion 24*a* which carries thereon a single bead B fed from the storage pipe 30. In order that the bead B is not carried directly on the support member 23*a*, the support member 24 (more specifically, the depressed portion 24*a*) capable of slidable movement along with the feed lever 23 on the bearing plate 18 is adapted to carry thereon the bead B. The support member 24 is further formed with a recess 24*b* at a distal end of the depressed portion 24*a* such as to permit the passage of the sewing needle 4. In a state where the bead B is carried on the bearing plate 18 (more specifically, the bead B is held by a pair of clamping claws 25 to be described hereinlater), a bead hole of the carried bead B is aligned with the recess 24*b*.

The pair of clamping claws 25 (a clamping section) is disposed on the depressed portion 24*a* in a manner to be interposed between the feed lever 25 and the depressed portion. For assuredly holding (retaining) the bead B with tips thereof, the paired clamping claws 25 are arranged in a manner to direct the respective claw portions thereof in face-to-face relation, the claw portions being formed in an arc-like shape conforming to an outer periphery of the bead B. These clamping claws 25 are each formed with an engaging hole 25*a*, and also formed with an engaging groove 25*b* defined by a corresponding outer peripheral portion thereof recessed toward the engaging hole 25*a*. A first pin (first member) 26 upstanding from the support member 24 is inserted in the engaging hole 25*a* of each of the clamping claws 25 so that each clamping claw 25 is supported by and directly mounted on the support member 24 in a manner to be rotatable about the engaging hole 25*a*. Further, the engaging groove 25*b* of each of the clamping claws 25 is engaged with a second pin (second member) 27 upstanding from the distal end of the feed lever 23. According to the above structure, the support member 24 is not fixedly mounted to the feed lever 23 but is allowed to move back and forth slightly relative to the feed lever 23. For this purpose, the position of the step formed on the bottom of the feed lever 23 and the length of the support member 24 are so decided as to ensure that a clearance is formed between the step on the bottom of the feed lever 23 and a rear end surface of the support member 24 when the feed lever 23 is at the rearmost position.

The bearing plate 18 is provided with a magnet (movement restricting member) 37 for imparting resistance against the movement of the support member 24. The magnet 37 is disposed at a forward position between the pair of guide plates 28 shown in FIG. 4 so that at the start of the forward or backward movement of the feed lever 23, only the feed lever 23 starts moving and the support member 24 starts moving with a delay. That is, the magnet 37 restricts the support member 24 from moving in the same direction as the feed lever 23 that has started moving, thereby providing a relative movement between the support member 24 and the feed lever 23 at the start of the forward or backward movement of the feed lever 23. The paired clamping claws 25 are adapted to be rotated while the feed lever 23 and the support member 24 move relative to each other. When the rotation of these clamping claws 25 is restricted (not made), both the feed lever 23 and the support member 24 make the same movement in the same direction. The rotating motion of the above clamping claws 25 will be described hereinlater (see FIG. 5 and FIG. 6).

As shown in FIG. 3, a restricting member 33 is fixed to the motor shaft 19*a* of the motor 19 while a stopper 34 capable of abutting contact against the restricting member 33 is fixed to the support plate 14. Thus, the motor shaft 19*a* of the drive motor 19 is restricted from counterclockwise rotation as seen in FIG. 3 by the restricting member 33 and the stopper 34. In FIG. 3, the phantom line depicts the restricting member 33 abutting against the stopper 34 as driven by the drive motor 19. The position depicted by the phantom line is equivalent to the foremost position to which the feed lever 23 is advanced.

The motor shaft 19*a* is provided with a torsion spring 35, which biases the restricting member 33 in a clockwise direction as seen in FIG. 3. Fixed to a rear side of the bearing plate 18 is a stopper 36 adapted for abutting contact against rear ends of the feed lever 23 and of the coupling member 22. Thus, the motor shaft 19*a* of the drive motor 19 rotated clockwise as seen in FIG. 3 is stopped at a position to bring the rear ends of the feed lever 23 and the coupling member 22 into abutting contact against the stopper 36. In FIG. 3, the solid line depicts the rear ends of the feed lever 23 and the coupling member 22 abutting against the stopper 36. The position depicted by the solid line is equivalent to the rearmost position to which the feed lever 23 is retreated. In this manner, the feed lever 23 is driven forward and backward to reciprocate between the position depicted by the phantom line and the position depicted by the solid line in FIG. 3.

Now, description is made on an operation of sewing the beads B one by one onto the sewing material (not shown), the operation being performed by the sewing machine equipped with the bead feeding unit 1 having the above-described structure. First, the operator loads the separate beads B in the storage pipe 30 in stacked relation. The beads B loaded in the storage pipe 30 may be exemplified by hundreds of separate beads B threaded together on a wire or the like by passing the wire through the bead holes formed centrally of the beads. The line of hundreds of beads B is inserted in the storage pipe 30 as follows. The storage pipe 30 is first removed from the bead feeding unit 1. The line of hundreds of beads B is inserted in the storage pipe 30 through an opening at an upper end thereof. Subsequently, the wire threaded through the bead holes of the hundreds of beads B is extracted from the upper end of the storage pipe 30 before the storage pipe 30 is mounted in the bead feeding unit 1. Thus, the hundreds of beads B are loaded in the storage pipe 30 in a mutually separated and stacked relation.

The storage pipe 30 and the coupling member 31 are formed with a hole 31*a* which is located at a position shown in FIG. 4 and extends therethrough to the inside of the storage pipe 30. If an unillustrated pin or the like is inserted in the hole 31*a* before loading a large number of beads B in the storage pipe 30, the loaded beads B are prevented from dropping out from the lower end of the storage pipe 30. This facilitates the operation of loading the beads B in the storage pipe 30. After the storage pipe 30 is mounted in the bead feeding unit 1, the inserted pin may be removed from the hole 31*a*. After the large number of beads B is loaded in the storage pipe 30, the beads B stacked in the storage pipe 30 are delivered one by one to the sewing position. In order to ensure that the remaining beads B in the storage pipe 30 may smoothly slide down through the storage pipe 30 in conjunction with the one by one bead delivery, a weight may be placed on the upper most bead B or otherwise, or a spring may be employed for biasing the remaining beads downward from above.

After the loading of the large number of beads B in the storage pipe 30 is completed, the sewing machine is activated to put the drive motor 19 of the bead feeding mechanism 11 into operation whereby the feed lever 23 is driven forward and backward for delivering a single bead B from the storage pipe 30 to the sewing position. Meanwhile the sewing machine head M performs a sewing operation to sew the single bead B, so delivered, onto the sewing material.

Figure 5:
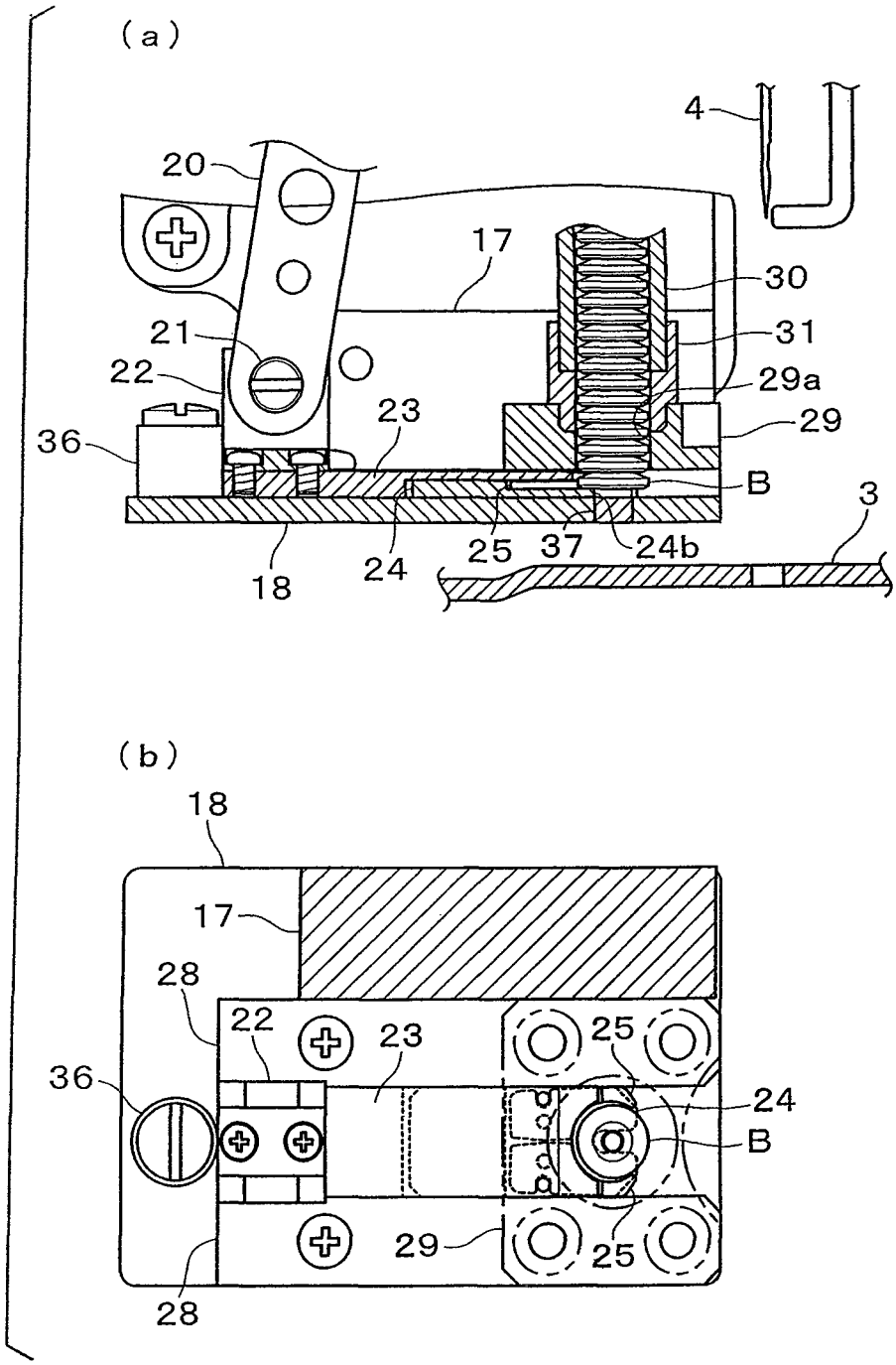
FIG. 5 is a set of side view and schematic plan view showing, in enlarged dimension, a principal part of the bead feeding mechanism with a feed lever retreated to the rearmost position.
Figure 6:
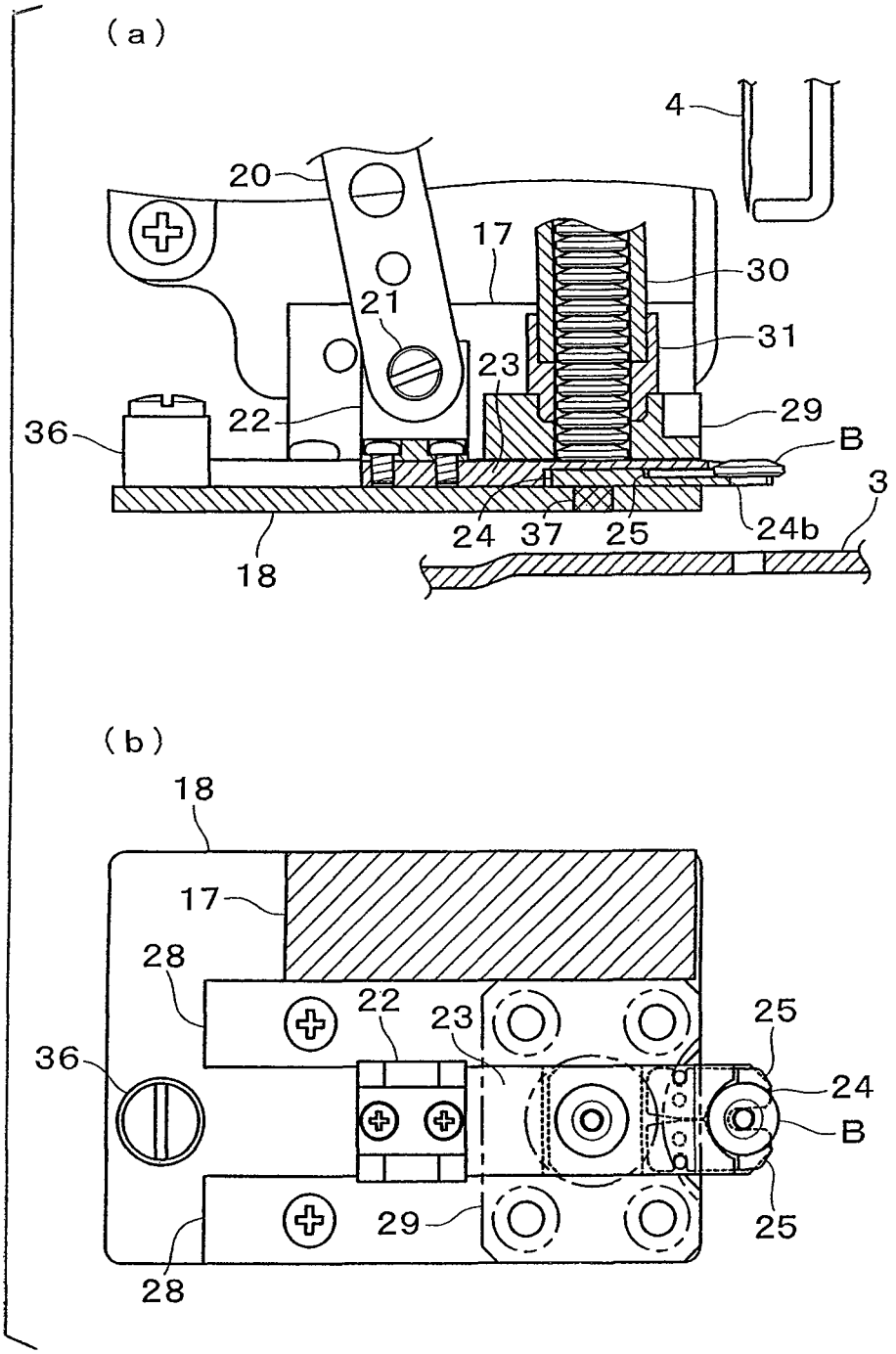
FIG. 6 is a set of side view and schematic plan view showing, in enlarged dimension, the principal part of the bead feeding mechanism with the feed lever advanced to the foremost position.
Figure 7:
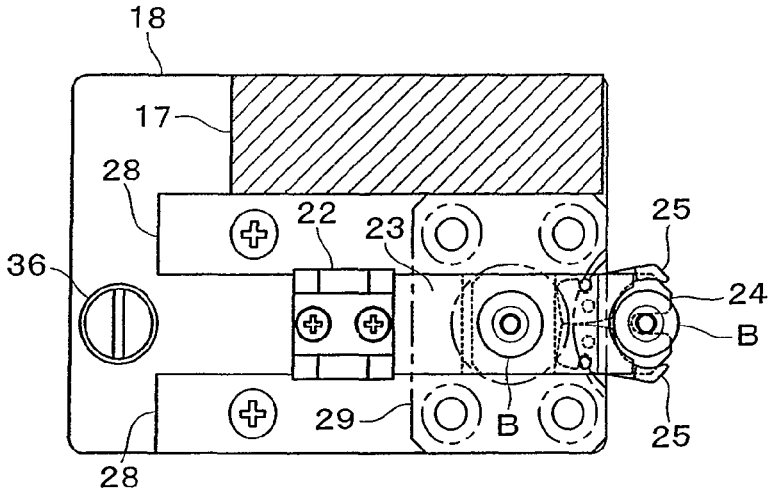
FIG. 7 is a schematic plan view showing, in enlarged dimension, the principal part of the bead feeding mechanism for illustrating an operation of clamping claws when the feed lever is retreated.
Figure 8:
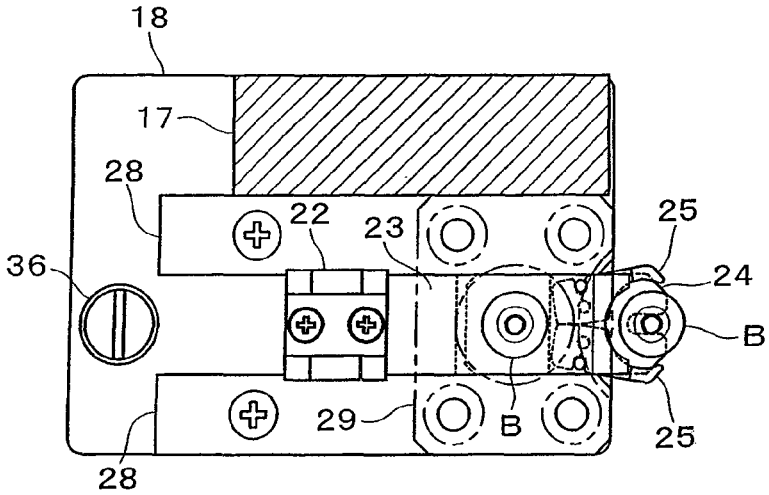
FIG. 8 is a schematic plan view showing, in enlarged dimension, the principal part of the bead feeding mechanism for illustrating the operation of the clamping claws when the feed lever is retreated.
Figure 9:
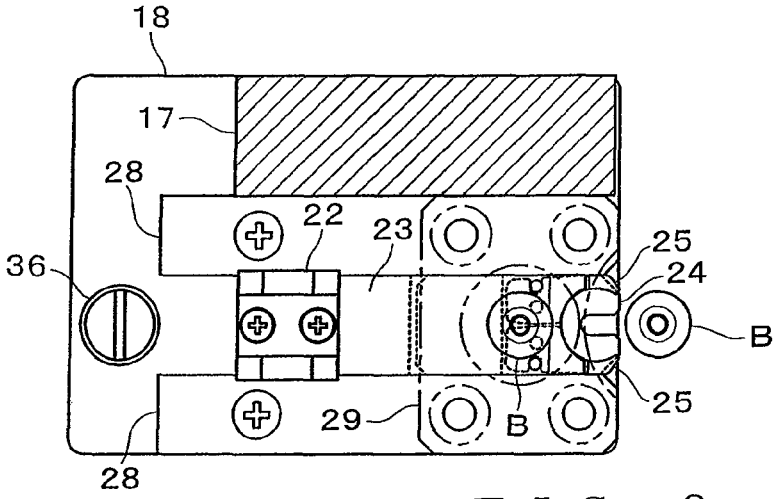
FIG. 9 is a schematic plan view showing, in enlarged dimension, the principal part of the bead feeding mechanism for illustrating the operation of the clamping claws when the feed lever is retreated.

Next, an operation of delivering the bead according to the embodiment is described with reference to FIG. 5 to FIG. 9. FIG. 5 is a set of side view and schematic plan view showing, in enlarged dimension, a principal part of the bead feeding mechanism 11 with the feed lever 23 retreated to the rearmost position. FIG. 6 is a set of side view and schematic plan view showing, in enlarged dimension, the principal part of the bead feeding mechanism 11 with the feed lever 23 advanced to the foremost position. FIG. 7 to FIG. 9 are schematic plan views each showing, in enlarged dimension, the principal part of the bead feeding mechanism 11 for illustrating an operation of the clamping claws 25 during the retreat of the feed lever 23.

At start time when a single bead B is yet to be delivered (with the drive motor 19 in off state), the feed lever 23 is retreated to the rearmost position shown in FIG. 5 by the biasing force of the torsion spring 35. At this time, the lowermost one of the large number of beads B loaded in the storage pipe 30 is fed onto the support member 24 through the through hole 29*a* of the pipe base 29. On the support member 24, the bead B is located between the clamping claw pair 25 opened a little wider than when holding therebetween the bead B on the support member 24 and at the front of the recess 23*a* at the distal end of the feed lever 23.

The feed lever 23 is moved forward to the right as seen in FIG. 5 by actuating the drive motor 19 in this state. At the beginning of the forward movement, only the feed lever 23 is moved while the support member 24 is restricted from movement by the magnetic force of the magnet 37. Such a relative movement of the feed lever 23 and the support member 24 causes the second pins 27 of the feed lever 23 to push forward the engaging grooves 25*b* of the paired clamping claws 25 whereby the paired clamping claws 25 are rotated inward about the engaging holes 25*a* with the first pins 26 inserted therein. Thus, the clamping claws 25 clampingly hold (retain) the bead B on the support member 24.

Subsequently, the paired clamping claws 25 are restricted from rotation by clamping the bead B therebetween while the feed lever 23 together with the support member 24 is moved to the foremost position shown in FIG. 6. With the feed lever 23 advanced to the foremost position, the bead hole of the delivered bead B is aligned with a needle drop hole or the sewing position (directly under the sewing needle) of the sewing needle 4. Therefore, the sewing needle 4 moved down is inserted in the bead hole of the delivered bead B.

After the sewing needle 4 is inserted in the bead hole of the bead B, the feed lever 23 is retreated by inversely rotating the drive motor 19. Only the feed lever 23 is moved immediately after the start of the backward movement, while the support member 24 is restricted from movement by the magnetic force of the magnet 37. As shown in FIG. 7, therefore, the second pins 27 of the feed lever 23 push rearward the engaging grooves 25*b* of the paired clamping claws 25 whereby the paired clamping claws 25 are rotated outward about the engaging holes 25*a* with the first pins 26 inserted therein. Thus, the clamping claws release the bead B clamped therebetween. The outward rotation of the clamping claws 25 is disabled by rear ends thereof abutting against each other. Subsequently, the feed lever 23 starts to retreat together with the support member 24.

When the feed lever 23 together with the support member 24 is retreated further to a position shown in FIG. 8, the outer peripheries of the clamping claws 25, rotated outward, abut against inner sides of the guide plates 28, respectively. As the feed lever 23 is retreated further, the clamping claws 25 are rotated inward to the retreat position shown in FIG. 9. Just before the retreat position shown in FIG. 9, the support member 24, which is carrying the bead B thereon, is moved back to place rearward of the bead B to allow the bead B to fall on the sewing material. The bead B is sewn onto the sewing material by the subsequent sewing operation. Although not shown in FIG. 7 to FIG. 9, the sewing needle 4 is inserted through the bead hole of the delivered bead B. With the clamping claws, on the outer sides thereof, opened a little and abutting against the inner sides of the guide plates 28, the feed lever 23 is moved back from the position shown in FIG. 9 to the position shown in FIG. 5 so that the subsequent bead B is allowed to fall on the support member 24. Subsequently, the beads B are delivered from the storage pipe 30 to the sewing position one by one by repeating the above-described operations.

As described above, a single bead B fed from the storage pipe 30 storing a large number of stacked beads B therein is carried not on the bearing plate 18 but on the support member 24 disposed independently from the bearing plate 18. Furthermore, the support member 24 carrying the bead B thereon is adapted to be moved forward or backward in conjunction with the feed lever 23. Thus, the bead B as carried on the support member 24 is delivered together with the support member 24. Hence, the bead B is not subjected to frictional resistance when delivered. Accordingly, the beads are always smoothly delivered from the storage pipe 30 to the sewing position, which eliminates the problem that the load on the drive motor 19 for driving the feed lever 23 varies on a bead B to bead B basis. Hence, the beads B can be delivered in a stable manner without increasing the capacity of the drive motor 19. Furthermore, the support member 24 is provided with the clamping claws 25 for clamping the bead B so that the bead B being clamped is delivered in conjunction with the movement of the feed lever 23. Hence, the bead B can be properly delivered as held in a more stable position. This permits the sewing machine to reliably sew the beads B onto the sewing material.

Second Embodiment

Figure 10:
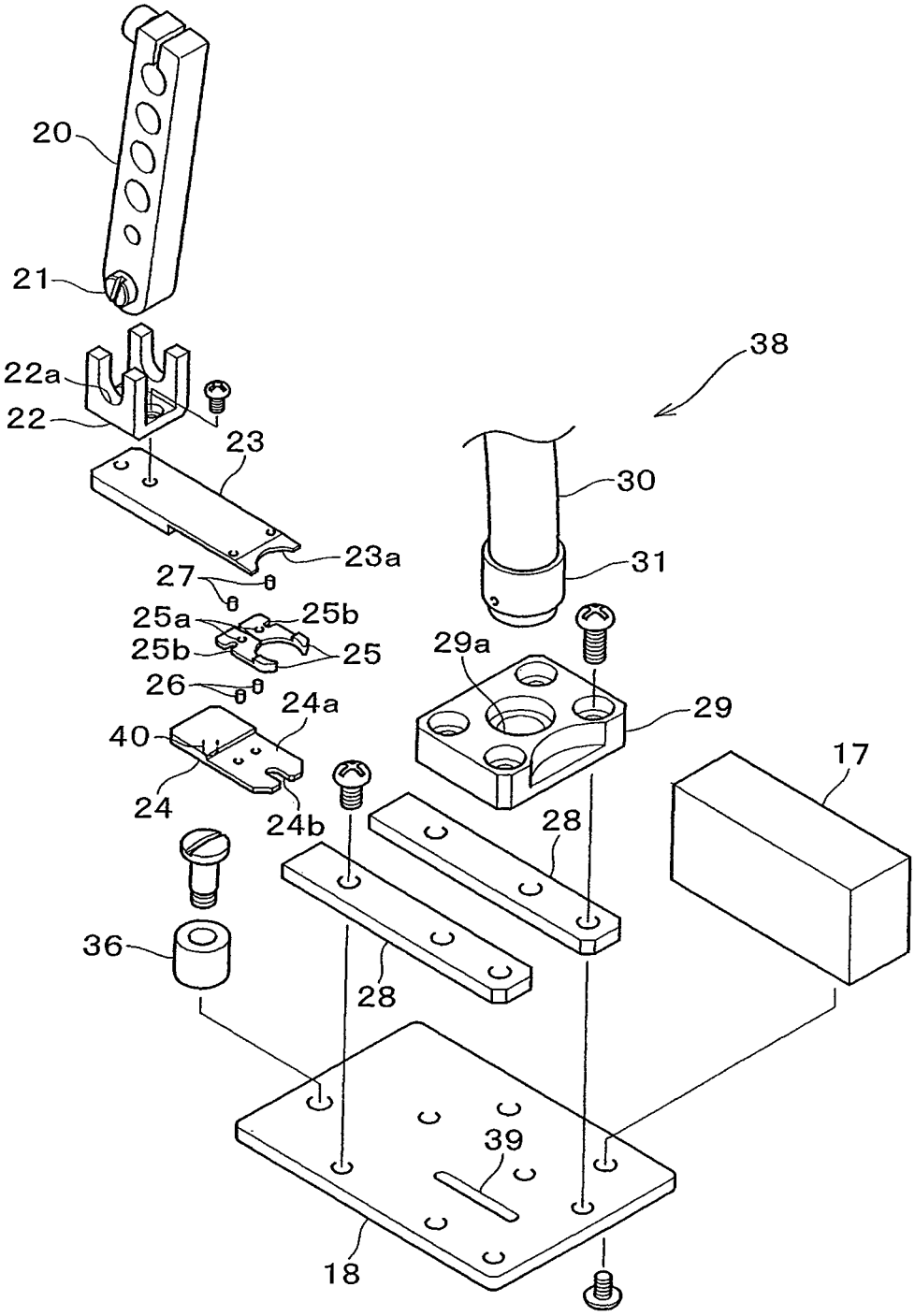
FIG. 10 is an exploded perspective view showing a bead feeding mechanism of a bead feeding unit according to a second embodiment of the present invention.

Next, description is made on a bead feeding mechanism according to another embodiment of the present invention. FIG. 10 is an exploded perspective view showing a bead feeding mechanism of a bead feeding unit according to a second embodiment of the present invention. In the figure, the same or similar reference numerals are used to refer to the same or similar components of the first embodiment described above. The bead feeding mechanism 38 shown in FIG. 10 has a different structure from that of the first embodiment. Specifically, the magnet 37 disposed on the bearing plate 18 is replaced by an elongate hole 39 extended in the direction of the forward/backward movement of the feed lever 23 while an engaging pin 40 engageable with the elongate hole 39 projects downward from the bottom surface of the support member 24 (the movement restricting member consisting of the elongate hole 39 and the engaging pin 40). Except for these, the bead feeding mechanism is constructed the same way as the bead feeding mechanism 11 (see FIG. 4) illustrated by the first embodiment and hence, the description thereof is omitted in the following description.

The bead feeding mechanism 38 illustrated by the second embodiment operates as follows. When the feed lever 23 is moved forward, the support member 24 is also moved forward together with the feeding lever 23. When the feed lever 23 comes close to the foremost position, however, the engaging pin 40 of the support member 24 abuts against a front end of the elongate hole 39 of the bearing plate 18 so that the support member 24 stops moving forward. Although the support member 24 stops moving forward, the feed lever 23 is moved further forward. As the feed lever 23 is moved further forward, the paired clamping claws 25 are rotated inward to clamp the bead B therebetween. Meanwhile the feed lever 23 reaches the foremost position. That is, the elongate hole 39 and the engaging pin 40 are adapted to provide the relative movement of the feed lever 23 and the support member 24 by restricting the support member 24 from being moved in the same direction as the feed lever 23.

When the feed lever 23 is at the foremost position, the support member 24 must be moved forward to cause the paired clamping claws 25 to rotate outward or to rotate in a direction to release the clamped bead B. According to this embodiment, however, the engaging pin 40 of the support member 24 abuts against the front end of the elongate hole 39, disabling the support member 24 to be moved further forward. This ensures that the paired clamping claws 25 do not rotate even if a sewing thread or the like comes into contact with any of the paired clamping claws 25 to apply an external force to open the clamping claws 25 clamping the bead B therebetween. Thus, the bead B is assuredly clamped by the clamping claws 25.

On the other hand, when the feed lever 23 starts to retreat after the insertion of the sewing needle 4 into the bead hole of the bead B, the paired clamping claws 25 become capable of rotation. Hence, the paired clamping claws 25 rotate outward as pushed by the bead B. When the outward rotation of the paired clamping claws 25 stops, the support member 24 also starts to retreat together with the feed lever 23 so that both the feed lever 23 and the support member 24 return to the rearmost position.

According to the second embodiment, even if the paired clamping claws 25 with the feed lever 23 advanced to the foremost position are subjected to any external force to rotate the clamping claws 25 in the direction to release the bead B clamped therebetween, the paired clamping claws 25 do not rotate, more reliably clamping the bead B therebetween. Therefore more reliable sewing of the bead B is ensured.

While the foregoing embodiments illustrate the pair of clamping claws 25 rotatable to clamp the bead B therebetween, the present invention is not limited to the disclosed embodiments. The clamping claws may have any other structure such as slidable claws for clamping the bead B therebetween.

This application is based on, and claims priority to JP PA 2011-046318 filed on 3 Mar. 2011. The disclosure of the priority application, in its entirety, including the drawings, claims, and the specification thereof, is incorporated herein by reference.

What is claimed is:

1. A bead feeder for delivering bead-shaped pieces, comprising:

a bearing plate;

a storage pipe storing therein a large number of separate bead-shaped pieces in stacked relation;

a feeding member adapted to be reciprocally moved on a top surface of the bearing plate so that the separate bead-shaped pieces are delivered one by one from the storage pipe to a position just beneath a sewing needle of a sewing machine in accordance with forward and backward movement of the feeding member;

a support member for carrying, on the bearing plate, a single bead-shaped piece fed from the storage pipe, the support member arranged movable on the bearing plate in conjunction with the forward and backward movement of the feeding member, the support member arranged to be moved relative to the feeding member at the time of the forward or backward movement of the feeding member; and a clamping section comprising a pair of claws for clamping a single bead-shaped piece carried on the support member, the clamping section operative to clamp the bead-shaped piece in conjunction with the relative movement of the feeding member and the support member, the pair of claws being directly mounted on the support member so that the clamping section moves along with the support member in conjunction with the forward and backward movement of the feeding member section.

2. The bead feeder according to claim 1, wherein the clamping section further includes a first member for rotatably supporting the pair of claws and a second member for rotating the pair of claws in response to the relative movement of the feeding member and the support member.

3. The bead feeder according to claim 1, further comprising a movement restricting member operating at the time of the forward or backward movement of the feeding member, restricting the support member from being moved in the same direction as the feeding member.

4. The bead feeder according to claim 2, further comprising a movement restricting member operating at the time of the forward or backward movement of the feeding member, restricting the support member from being moved in the same direction as the feeding member.

* * * * *